US007612028B2

(12) United States Patent
Lee et al.

(10) Patent No.: US 7,612,028 B2
(45) Date of Patent: Nov. 3, 2009

(54) THINNER COMPOSITION, METHOD OF PREPARING THE SAME AND METHOD OF RECOVERING THE SAME

(75) Inventors: Dong-Ki Lee, Seoul (KR); Jin-Ho Ju, Seoul (KR); Hi-Kuk Lee, Yongin-si (KR); Seon-Su Sin, Cheonan-si (KR); Kwang-Soo Lee, Seoul (KR); Jae-Woong Mun, Yangsan-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 687 days.

(21) Appl. No.: 11/294,058

(22) Filed: Dec. 5, 2005

(65) Prior Publication Data

US 2006/0124596 A1 Jun. 15, 2006

(30) Foreign Application Priority Data

Dec. 9, 2004 (KR) ..... 10-2004-0103621

(51) Int. Cl.
*C11D 7/50* (2006.01)

(52) U.S. Cl. ..... 510/175; 510/201; 510/407

(58) Field of Classification Search ..... 510/175, 510/201, 407

See application file for complete search history.

(56) References Cited

U.S. PATENT DOCUMENTS

| | | | | |
|---|---|---|---|---|
| 5,750,632 | A * | 5/1998 | Rahman et al. | 528/129 |
| 5,916,729 | A * | 6/1999 | Kobayashi et al. | 430/270.1 |
| 6,015,467 | A * | 1/2000 | Nagasawa et al. | 134/1 |
| 6,589,719 | B1 * | 7/2003 | Ahn et al. | 430/331 |
| 2004/0076910 | A1 * | 4/2004 | Rutter et al. | 430/311 |
| 2007/0027231 | A1 * | 2/2007 | Goto et al. | 523/160 |

* cited by examiner

*Primary Examiner*—Gregory E Webb
(74) *Attorney, Agent, or Firm*—F. Chau & Associates, LLC

(57) ABSTRACT

A thinner composition is provided which includes about 60-80% by weight of propylene glycol mono-alkyl ether having a boiling point of $T_1$° C., about 10-30% by weight of alkyl acetate having a boiling point of $T_2$° C., and about 1-10% by weight of a solvent. The solvent has a boiling point of $T_3$° C. and satisfies the equation (1).

$$T_2<T_3<T_2+30 \quad (1).$$

7 Claims, 2 Drawing Sheets

THINNER COMPOSITION, METHOD OF PREPARING THE SAME AND METHOD OF RECOVERING THE SAME

CROSS REFERENCE TO RELATED APPLICATION

This application claims priority to Korean Patent Application No. 2004-103621 filed on Dec. 9, 2004, the contents of which are herein incorporated by reference in their entirety.

BACKGROUND OF THE INVENTION

1. Field of the Invention

The present invention relates to a thinner composition, a method of preparing the same and a method of recovering the same More particularly, the present invention relates to a thinner composition for cleaning/washing an object, (e.g. spray nozzle of a linear coating machine) having a photoresist disposed therewith, a method of preparing the same and a method of recovering the same.

2. Description of the Related Art

When manufacturing a display device including a liquid crystal display device (LCD), a lithography technique is typically applied to produce an electric circuit or pixels for displaying color. The lithography process is used for forming minute patterns on a substrate. A substrate on which a photoresist is coated is then exposed to light by means of a mask having a desired pattern, to transfer the circuit pattern of the mask onto the substrate.

The exposed portion or unexposed portion of the coated photoresist is selectively removed during implementation of a developing process depending upon the particular kind of the photoresist being used. As a result, a photoresist pattern corresponding to the desired circuit pattern is obtained.

Generally, to coat the photoresist (PR) uniformly for implementing the photolithography process, a constant amount of PR is placed onto the substrate. The substrate is then rotated by means of a rotational force to spread the photoresist onto the whole surface of the substrate to form a PR layer.

However, when the PR is coated onto the substrate by means of the rotational force, the PR is spread out not only to a portion on which PR patterns are to be formed but also to portions of the substrate in which PR patterns are not meant to be formed, such as an edge portion, a side portion or a backside portion of the substrate ("referred to as extraneous or undesired portions of the substrate").

If the PR is allowed to remain on the above described extraneous or undesired portions of the substrate, this might induce contamination of the equipment used in formation of the LCD device, thereby also leading to defects in subsequent processing steps in forming the LCD device. Therefore, after coating the PR component, the excess PR on the undesired portions of the substrate need to be removed. Conventional thinner compositions are typically used to remove excess PR formed on undesired portions of a surface or substrate during implementation of a lithography process. For example in one such conventional process, when the PR is coated on the substrate by means of a spin coating method, the thinner composition is sprayed while spinning the substrate to remove the PR around the periphery portion of the substrate.

However, in situations where the substrate has a square shape including a glass substrate, the distance from the center portion of the substrate to each edge portion is not the same. Thus, the removal of the PR components by spraying the thinner composition during the rotation becomes difficult.

Accordingly to overcome the above difficulties, a method of dipping a target edge portion of the substrate on which the PR component to be removed is also used.

According to the above described dipping method, the PR is removed from the undesired portions of the substrate via a straight back-and-forth motion of the thinner spraying apparatus along the substrate edge portion. Nevertheless, even this method still has difficulties in connection with larger sized substrates.

Recently, to solve the above-described difficulty for larger-sized substrates, a linear coating method has been used instead of the rotation method for implementing lithography. That is, without moving the substrate, the PR is coated onto the substrate by using a spray nozzle, the size of which corresponds to one edge of the substrate.

The nozzle moves linearly to form a uniform photoresist layer on the whole surface of the substrate. According to this non-rotational, linear coating method, the PR is coated onto a desired portion of the substrate. Without also coating the PR onto any undesired portions of the substrate, such as the edge portion, the side portion or the backside portion of the substrate. Therefore, a subsequent washing of these undesired portions of the substrate is not required.

However, when the PR is sprayed using the non-rotational, linear coating method, the nozzle state should be kept clean. The reason the nozzle should be kept clean is that after spraying the PR through the spray nozzle and onto the substrate, portions of the nozzle such as the end portion and the periphery portion of the nozzle might become contaminated by the PR residue left from a previous spray coating.

The thickness of the PR layer coated on the substrate is generally very thin, at about 1 μm. Accordingly, a contaminated or unclean PR spraying nozzle due to even minute PR contaminants might affect the coating state of subsequent PR coating processes. That is, for example, when spray coating the PR through a nozzle having both a contaminated portion and uncontaminated portion, this results in a coating layer forming on a substrate with a non-uniform thickness, thereby inducing difficulties or defects in subsequent processing steps in forming an LCD device.

Therefore, a thinner composition for maintaining a PR spray nozzle in a clean state is needed. Moreover, as most of the thinner composition is treated as waste after completing the washing/cleaning process at the spray nozzle, a thinner composition which is able to be separated from the waste thinner and recovered for recycling, thereby reducing the manufacturing costs of the display device is also needed.

SUMMARY OF THE INVENTION

In accordance with an exemplary embodiment of the present invention, a thinner composition is provided. The thinner composition includes about 60-80% by weight of propylene glycol mono-alkyl ether having a boiling point of $T_1$° C., about 10-30% by weight of alkyl acetate having a boiling point of $T_2$° C., and about 1-10% by weight of a solvent. The solvent has a boiling point of $T_3$° C. and satisfies equation (1), i.e.

$$T_2<T_3<T_2+30 \quad (1)$$

In accordance with another exemplary embodiment of the present invention, a thinner composition is provided. The thinner composition includes about 60-80% by weight of propylene glycol mono-methyl ether (PGME), about 10-30% by weight of n-butyl acetate (NBA), and about 1-10% by weight of propylene glycol mono-methyl ether acetate (PGMEA).

In accordance with still another exemplary embodiment of the present invention, a thinner composition is provided. The thinner composition includes a first component having the highest boiling point of $T_h$° C. among a plurality of effective components in the composition and a second component including a solvent. The solvent has a boiling point of $T_1$° C. and satisfies the equation (2), i.e., $$T_h<T_1<T_h+30 \quad (2)$$

In accordance with still another exemplary embodiment of the present invention, a method of preparing a thinner composition is provided. The method includes providing a plurality of effective components. The method further comprises adding a second component including a solvent. The solvent has a boiling point of $T_1$° C. and satisfying equation (2), i.e. $T_h<T_1<T_h+30$ (2), and wherein one of the plurality of effective components is a first component having a boiling point of $T_h$° C. which is the highest boiling point among the plurality of effective components in the composition.

In accordance with still another exemplary embodiment of the present invention, a method of recovering a thinner composition from a waste composition is provided. The method comprises heating a waste thinner composition at a temperature from about $T_1$-5° C. to about $T_1$° C. The waste thinner composition includes a photoresist including a second component having a boiling point of $T_1$° C. and satisfying the equation (2), and a thinner composition including a first component having a boiling point of $T_h$° C. which is the highest boiling point among a plurality of effective components and the second component. Thereafter, a thinner composition is fractionally distilled from the waste thinner composition.

$$T_h<T_1<T_h+30 \quad (2)$$

In accordance with still another exemplary embodiment of the present invention, a method of recovering a thinner composition is provided. The waste thinner composition includes a thinner composition including propylene glycol mono-methyl ether (PGME), n-butyl acetate (NBA) and propylene glycol mono-methyl ether acetate (PGMEA), and a photoresist including propylene glycol mono-methyl ether (PGME), diethylene glycol dimethyl ether (DMC) and ethyl ethoxy propionate (EEP). The waste thinner composition is fractionally distilled at a temperature range of from about 141° C. to about 146° C.

In accordance with another exemplary embodiment of the present invention, a method for using a thinner composition to clean an object having a photoresist disposed therewith is provided. The method includes forming a thinner composition comprising about 60-80% by weight of propylene glycol mono-alkyl ether having a boiling point of $T_1$° C., about 10-30% by weight of alkyl acetate having a boiling point of $T_2$° C., and about 1-10% by weight of a solvent, the solvent having a boiling point of $T_3$° C. and satisfying the equation (1), i.e., $T_2<T_3<T_2+30$ (1). The method further comprises washing the object having the photoresist disposed therewith with the thinner composition.

DESCRIPTION OF THE EXEMPLARY EMBODIMENTS OF THE INVENTION

Figure 1:
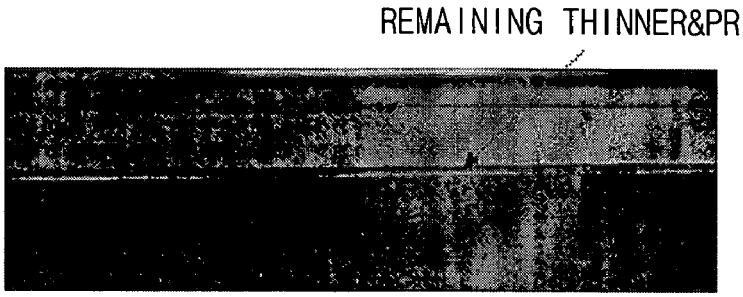
FIG. 1 is a photograph taken after coating a photoresist once and then washing a nozzle lip using a thinner composition prepared according to an exemplary embodiment of the present invention as set forth in Example 1.

The exemplary embodiments of the present invention will be described in more detail below.

In an exemplary embodiment of the present invention, a thinner composition is provided for cleaning/washing an object having a photoresist (PR) disposed therewith. In this exemplary embodiment, the object is a spray nozzle of a linear coating machine. Moreover, the term photoresist (PR) herein encompasses photoresists existing in all forms known in the art, such for example, including but not limited to photoresist coatings, compositions, solutions, formulations, mixtures, etc.

The thinner composition includes about 60-80% by weight of propylene glycol mono-alkyl ether and about 10-30% by weight of alkyl acetate. In addition, the thinner composition includes about 1-10% by weight of a solvent. Moreover, the same solvent used in the PR to be washed is also preferably included in the thinner composition. The propylene glycol mono-alkyl ether and the alkyl acetate are effective components in providing the cleansing effect of the thinner composition. The solvent is included in the thinner composition for recovering the thinner composition from the waste composition as will be described further below.

In addition, the solvent included in the thinner composition should have a similar boiling point to that of the alkyl acetate included in the thinner composition. Preferably, the solvent included in the thinner composition has a boiling point temperature difference of about 30° C. or less from that of the alkyl acetate. Solvents which have a boiling point which differ from the boiling point temperature of the alkyl acetate component of the thinner composition by more than 30° C., should preferably not be included in the thinner composition. In this case, only the effective components without the solvent are included in the thinner composition.

As discussed, the solvent used in the thinner composition of the exemplary embodiments of the present invention should have a boiling point similar to that of the alkyl acetate component, so that the effective components cannot be easily separated by means of a conventional fractional distilling apparatus.

Propylene glycol mono-alkyl ether acetate (PGMEA) is preferably used as the solvent in the thinner composition. Propylene glycol mono-alkyl ether acetate includes propylene glycol mono-methyl ether acetate, propylene glycol mono-ethyl ether acetate, propylene glycol mono-propyl ether acetate, and the like. Moreover, PGMEA is used as a solvent in most photoresist solutions and so is more preferred. The boiling point of PGMEA is about 162° C. and is similar to that of the alkyl acetate included in the thinner composition.

The alkyl acetate component of the thinner composition includes n-propyl acetate, iso-propyl acetate, n-butyl acetate, iso-butyl acetate, and the like.

The propylene glycol mono-alkyl ether (PGME) component of the thinner composition includes propylene glycol mono-methyl ether, propylene glycol mono-ethyl ether, propylene glycol mono-propyl ether, and the like.

Two or more solvents should only be included in the thinner composition when the boiling point difference between the solvent and the alkyl acetate of the thinner composition is less than 30° C. and these same two or more solvents are also included in the photoresist to be washed. Here, the preferred amount of the solvent is about 1-10% by weight based on the total amount of the composition, because when the amount of the solvent exceeds 10% by weight, the cleaning efficiency of the thinner composition is significantly lowered.

The preferred amount of the alkyl acetate is about 10-30% by weight. When the amount of the alkyl acetate is less than 10% by weight, the volatility of the composition is too low, thereby inducing a drying defect. When the amount of the alkyl acetate exceeds 30% by weight, the volatility of the composition is too high and the photoresist might attach again to the object being cleaned, e.g. spray nozzle of a linear coating machine, thereby hindering an effective cleaning of the PR from the object from taking place.

The thinner composition preferably includes about 60-80% by weight of PGME, about 10-30% by weight of n-butyl acetate (NBA) and about 1-10% by weight of PGMEA. In this exemplary embodiment, the photoresist to be washed includes propylene glycol mono-methyl ether acetate (PGMEA), ethyl ethoxy propionate (EEP) and diethylene glycol dimethyl ether (DMC), as solvents. Thus, the waste thinner composition includes the following components having the given boiling points illustrated in Table 1.

TABLE 1

| component | Boiling point (° C.) |
|---|---|
| PGME | 118 |
| NBA | 124 |
| PGMEA | 146 |
| DMC | 162 |
| EEP | 170 |

As shown in Table 1, the boiling point of propylene glycol mono-ether and that of n-butyl acetate are similar and thus separating them is difficult. However, the above result is desirable since the above effective components of the thinner composition are preferably used again after the recovering them from the waste composition for recycling. Thus the effective components should not be separated from one another. The boiling point difference of diethylene glycol dimethyl ether and ethyl ethoxy propionate (hereinafter referred to as contaminants) with NBA is large and so the separation of the contaminants from NBA is relatively easy. On the other hand, the difference between the boiling point of propylene glycol mono-methyl ether acetate and the boiling point of the other effective components, such as propylene glycol mono-methyl ether or n-butyl acetate or contaminants, such as diethylene glycol dimethyl ether or ethyl ethoxy propionate is an intermediate one, thereby still rendering it difficult, to separate propylene glycol mono-methyl ether acetate from the effective components or from the contaminants of the thinner composition.

When propylene glycol mono-methyl ether acetate is not included in the thinner composition, the effective components of propylene glycol mono-methyl ether and n-butyl acetate will likely be separated in large part from propylene glycol mono-methyl ether acetate in the waste thinner composition during recovery of the thinner composition from the waste thinner composition, thereby decreasing the efficiency for recovering the thinner composition. As discussed, the waster thinner composition includes a mixture of the thinner composition and the washed PR at the spray nozzle.

However, when an excessive amount of propylene glycol mono-methyl ether acetate is included in the thinner composition, propylene glycol mono-methyl ether acetate will likely be separated in large part from diethylene glycol dimethyl ether and ethyl ethoxy propionate. The above separation will also decrease the efficiency for recovering the thinner composition from the waste thinner composition. Thus, the preferred amount of propylene glycol mono-methyl ether acetate is about 1-10% by weight in the thinner composition.

The preferred amount of n-butyl acetate in the thinner composition is about 10-30% by weight. When the amount of n-butyl acetate is 10% by weight or less, the volatility of the composition is too low, thereby inducing a drying defect. When the amount of n-butyl acetate exceeds 30% by weight, the photoresist might attach again.

In particular, when washing a linear-type nozzle using the thinner composition of the exemplary embodiments is implemented, and the amount of n-butyl acetate included in the thinner composition is 10% by weight or less, a complete drying of the thinner composition does not occur. Accordingly, the purity of the coating solution might be lowered due to remaining waste thinner solution at the nozzle when a subsequent coating of photoresist onto a surface, e.g. substrate is performed, thereby possibly resulting in a non-uniform thickness for the coating layer on the substrate being coated with the photoresist.

To prepare a thinner composition according to an exemplary embodiment of the present invention, at least one effective component and a solvent should be included in forming the thinner composition. The solvent is preferably the same solvent included in the photoresist to be washed. The solvent included in the thinner composition has a boiling point of $T_1$° C. and should satisfy the following equation (2) set forth below. Among the effective components, a first component has the highest boiling point of $T_h$° C. among the effective components.

$$T_h<T_1<T_h+30 \quad (2)$$

If a plurality of solvents satisfying the equation (2) is included in the photoresist, the plurality of the solvents may also be included in the thinner composition. Here, the mixing ratio of the solvents should be controlled to keep the cleansing efficiency sufficiently high.

Propylene glycol mono-methyl acetate is used as a solvent for the preparation of the most of the photoresists. Therefore, the PGMEA component is preferably included for the preparation of the thinner composition. In addition, as the effective component having the highest boiling point of $T_h$° C., n-butyl acetate is preferably used.

To separate and recover the thinner composition from the waste thinner composition, a fractional distillation method is used.

The preferred temperature for the fractional distillation is the boiling point of a solvent included in the thinner composition, that is, $T_1$° C. or alternatively a temperature range of from about $T_1$-5° C. to about $T_1$° C. When the temperature of the fractional distillation is higher than the boiling point of the solvent ($T_1$° C.), other impurities from the waste thinner composition other than the solvent and effective components of the thinner composition might be recovered.

For the waste thinner composition illustrated in Table 1, the fractional distillation should be implemented at about 141-

146° C. to recover the components of the thinner composition such as PGME, NBA and PGMEA from the waste thinner composition.

Thus, the recovered thinner composition can be recycled. To re-use the recycled thinner composition, the recovered components should be analyzed and any deficient component should be refilled.

Hereinafter, the present invention will be described in more detail with reference to preferred embodiments. However, it should be understood that the present invention is not limited to the following examples.

Examples 1-6

Thinner compositions according to exemplary embodiments of the present invention were prepared with the components illustrated in Table 2.

Comparative Examples 1-6

To compare the thinner compositions of the exemplary embodiments of the present invention, comparative thinner compositions were prepared with the components illustrated in Table 2.

TABLE 2

| | Component | | |
|---|---|---|---|
| | NBA (% by weight) | PGME (% by weight) | PGMEA (% by weight) |
| Example 1 | 10 | 85 | 5 |
| Example 2 | 20 | 75 | 5 |
| Example 3 | 30 | 65 | 5 |
| Example 4 | 20 | 70 | 10 |
| Example 5 | 30 | 60 | 10 |
| Example 6 | 10 | 80 | 10 |
| Comparative Example 1 | 45 | 45 | 10 |
| Comparative Example 2 | 65 | 25 | 10 |
| Comparative Example 3 | 20 | 5 | 75 |
| Comparative Example 4 | 45 | 10 | 45 |
| Comparative Example 5 | 20 | 80 | |
| Comparative Example 6 | | 70 | 30 |

Experiment 1: Estimation of Cleaning Efficiency

To estimate the cleaning efficiency of the thinner compositions prepared by the Examples in comparison to the Comparative Examples in connection with cleaning/washing the spraying nozzle of a linear coating machine of a non-rotational photoresist, a linear coating machine for a $7^{th}$ generation TFT-LCD manufactured by DAI NIPPON SCREEN Mfg. Co., Ltd. in Japan was used. As the photoresist, a novolak-based positive photoresist having a low viscosity and developed for the linear coating was used. PGMEA, DMC and EEP were used as the solvents of the photoresist. After completing the coating of the photoresist using a linear coating machine, the nozzle was washed using a thinner composition sprayed by a nozzle washing apparatus. After the washing, nitrogen was sprayed from a nozzle drying machine to dry.

After completing the drying, the cleaning state and the drying state of the drying nozzle were observed with the naked eye. After this observation, the photoresist was coated onto the glass substrate to estimate the coated state of the photoresist on the substrate. The estimation results of the above-described items are illustrated in Table 3. It is noted that state "A" depicted in Table 3 below, refers to the most desirable or optimum state for cleaning, drying and coating, while state "B" is a less desirable than state "A". State "C" is the least desirable state of the three states.

TABLE 3

| | Cleansing state of nozzle (photoresist remaining state) | Drying state of nozzle (thinner remaining state) | Coated state of photoresist after washing |
|---|---|---|---|
| Example 1 | A | A | A |
| Example 2 | A | A | A |
| Example 3 | A | A | A |
| Example 4 | A | A | A |
| Example 5 | A | A | A |
| Example 6 | A | A | A |
| Comparative Example 1 | B | A | B |
| Comparative Example 2 | B | A | B |
| Comparative Example 3 | C | C | B |
| Comparative Example 4 | C | B | B |
| Comparative Example 5 | A | A | A |
| Comparative Example 6 | A | A | A |

As shown in Table 3, the cleansing efficiency of the thinner composition prepared by Examples 1-6 exhibit preferable performances to that of the thinner composition prepared by Comparative Examples 1-4.

Further, as shown in the results corresponding to Comparative Examples 1-2, the cleansing efficiency of the thinner composition is lowered when the amount of n-butyl acetate is excessively large and the amount of propylene glycol monomethyl ether is small. In addition, drying is completed too quickly and a residual layer of the photoresist remains, thereby inducing a defect during a subsequent coating of the photoresist on the substrate.

As shown in Comparative Examples 3 & 4, when the amount of propylene glycol mono-methyl ether acetate is excessively large, a drying defect according to the decrease of the volatility is generated. In such a case, the amount of propylene glycol mono-methyl ether becomes too small, and the solubility with respect to the photoresist decreases, thereby inducing a coating defect of the photoresist.

Experiment 2: Estimation of Recovering Ratio of the Thinner Composition

To plan to prepare a waste thinner composition, 5% by weight of DMC and EEP were added to the thinner composition prepared by Examples and Comparative Examples 5 & 6. The waste compositions, prepared using the thinner composition of Examples and Comparative Examples, were injected into a pilot distillation tower manufactured using a glass of theoretical plate of 20 and a diameter of 100 mm. Thereafter, a batch distillation was implemented to recover the effective components of the thinner composition to a purified degree of above 99.5%. The results are illustrated in Table 4.

TABLE 4

| | Recovering ratio of effective component (%) | Purity of recovered effective component (wt %) | Reflux ratio of distillation tower*1 |
|---|---|---|---|
| Example 1 | 95 | 99.9 | 3 |
| Example 2 | 95 | 99.8 | 3 |
| Example 3 | 92 | 99.8 | 3 |
| Example 4 | 91 | 99.6 | 3 |
| Example 5 | 91 | 99.6 | 3 |
| Example 6 | 92 | 99.7 | 3 |
| Comparative Example 5-1*2 | 72 | 99.5 | 3 |
| Comparative Example 6-1 | 75 | 99.6 | 3 |
| Comparative Example 5-2 | 82 | 99.6 | 5 |
| Comparative Example 6-2 | 84 | 99.6 | 5 |

*1reflux ratio: the ratio of refluxing amount with respect to non-refluxing amount when a portion of the content at the upper side of the distillation tower is refluxed. The remaining operating condition, other than that of the reflux ratio, was kept the same.
*2the compositions of Comparative Examples 5-1 & 5-2 and 6-1 & 6-2 include the same component in the compositions of Comparative Examples 5 and 6, respectively. Only the distilling condition during recovering was different.

As shown in Table 4, the recovering ratio of the waste composition including the thinner compositions prepared by Examples 1-6 is higher by about 20% than that of the waste composition including the thinner compositions prepared by Comparative Examples 5-1 and 6-1, when the purity of the recovered product under the same operating condition of the distillation tower of the same reflux ratio were similar.

For the experiment implemented to increase the recovering ratio of the comparative example, a more intense operating condition was applied for Comparative Examples 5-2 and 6-2. For these cases the recovering ratio of Examples 1-6 was increased by about 10%.

To increase the recovering ratio in Comparative Examples under the same operating condition, the purity of the recovered effective components should be lowered. To increase the recovering ratio while keeping the high purity, the reflux ratio should be increased. However, the above adjustments to the Comparative Examples will result in an increase in operating costs and also a decrease in the effectiveness of recovering the thinner composition.

Experiment 3: Observation of Nozzle and Coating Surface After Coating Again

The nozzle lip was observed after coating the photoresist once and then washing the nozzle lip. In addition, the coated surface was observed after implementing the coating once or twice.

Figure 2:
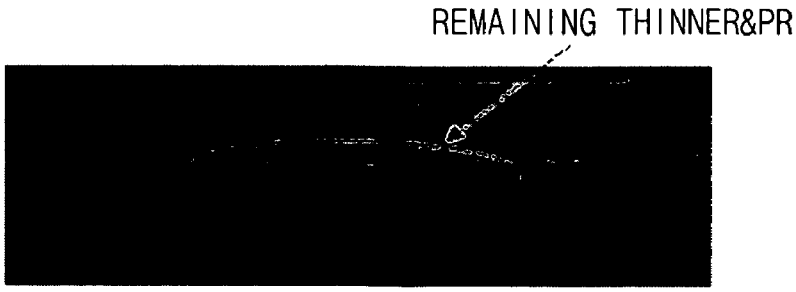
FIG. 2 is a photograph taken after coating a photoresist once and then washing a nozzle lip using a thinner composition prepared by Comparative Example 3.

Referring to FIGS. 1 and 2, the remaining thinner composition and photoresist components are illustrated as a thick line for the nozzle washed using the thinner composition prepared by Comparative Example 3. On the contrary, the lines are illustrated thinner for the nozzle washed using the thinner composition prepared by Example 1. Therefore, the above results indicate that the state of cleanliness of the nozzle washed using the thinner composition of the exemplary embodiments of the present invention are significantly better than the state of cleanliness of the nozzle washed with a conventional thinner composition such as the thinner composition of Comparative example 3.

Figure 3:
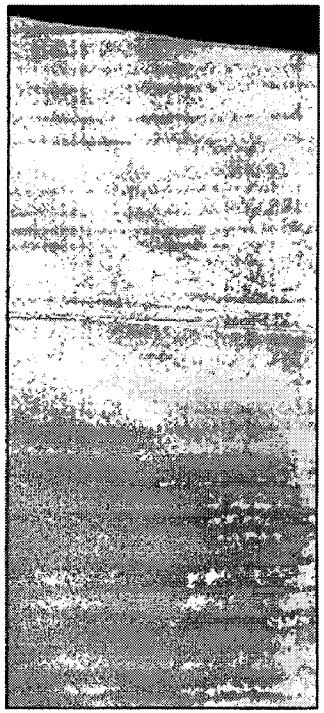
FIG. 3 is a photograph taken for a coating layer after coating a photoresist once, washing a nozzle lip using a thinner composition prepared according to an exemplary embodiment of the present invention as set forth in Example 1 and then coating the photoresist by means of the washed nozzle lip.
Figure 4:
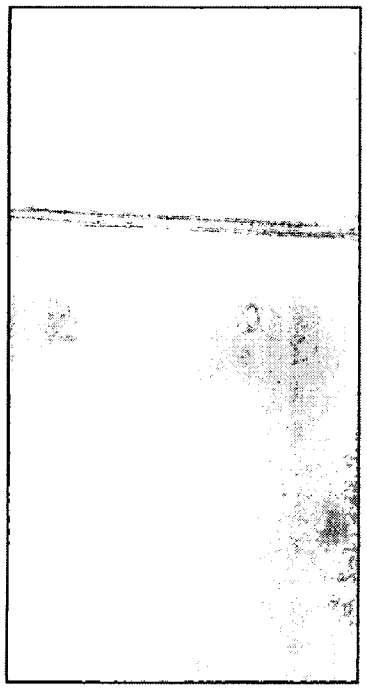
FIG. 4 is a photograph taken for a coating layer after coating a photoresist once, washing a nozzle lip using a thinner composition prepared by Comparative Example 3 and then coating the photoresist by means of the washed nozzle lip.

Referring to FIGS. 3 and 4, the coated surface was observed after washing the nozzle lip and coating again. Rough stains were observed on the coated layer formed by means of the nozzle washed using the thinner composition of Comparative Example 3. Again the above results indicate that the state of cleanliness of the nozzle is even better when applying the thinner composition of the exemplary embodiments of the present invention as opposed to conventional thinner compositions such as those set forth in Comparative example 3.

In sum, the thinner composition of the exemplary embodiments of the present invention exhibits good cleaning properties. In addition, the thinner composition of the exemplary embodiments provides for a thinner composition which may be recovered from a waste thinner composition for recycling purposes. Further, the recovery ratio of the thinner composition of the exemplary embodiments of the present invention is also very high, providing a very good yield for recycling purposes.

In particular, when the thinner composition of the exemplary embodiments of the present invention is used for washing a spraying nozzle of a linear coating machine, rarely is any PR left remaining on or in the spray nozzle after washing, thereby maintaining the nozzle in state of cleanliness.

Having described the exemplary embodiments of the present invention, it is further noted that various modifications can be made herein without departing from the spirit and scope of the invention as defined by the metes and bounds of the appended claims.

What is claimed is:

1. A thinner composition, comprising:

about 60-80% by weight of propylene glycol mono-alkyl ether having a boiling point of $T_1$° C.;

about 10-30% by weight of alkyl acetate having a boiling point of $T_2$° C.; and about 1-10% by weight of a solvent, the solvent having a boiling point of $T_3$° C. and satisfying the equation (1):

$$T_2<T_3<T_2+30 \quad (1).$$

2. The thinner composition of claim 1, wherein the alkyl acetate comprises at least one selected from the group consisting of n-propyl acetate, iso-propyl acetate, n-butyl acetate or iso-butyl acetate.

3. The thinner composition of claim 1, wherein the propylene glycol mono-alkyl ether comprises at least one selected from the group consisting of propylene glycol mono-methyl ether, propylene glycol mono-ethyl ether or propylene glycol mono-propyl ether.

4. The thinner composition of claim 1, wherein the solvent for the photoresist is propylene glycol mono-alkyl ether acetate.

5. The thinner composition of claim 4, wherein the propylene glycol mono-alkyl ether acetate comprises at least one selected from the group consisting of propylene glycol mono-methyl ether acetate, propylene glycol mono-ethyl ether acetate or propylene glycol mono-propyl ether acetate.

6. A thinner composition, comprising;

about 60-80% by weight of propylene glycol mono-methyl ether (PGME);

about 10-30% by weight of n-butyl acetate (NBA); and about 1-10% by weight of propylene glycol mono-methyl ether acetate (PGMEA).

7. The thinner composition of claim 6, further comprising ethyl ethoxy propionate (EEP) and diethylene glycol dimethyl ether (DMC).

* * * * *